United States Patent [19]

Groswith, III

[11] Patent Number: 4,743,048

[45] Date of Patent: May 10, 1988

[54] MULTI-FOLD ADJUSTABLE BINDER, BOOK, AND METHOD

[75] Inventor: Charles T. Groswith, III, Los Altos, Calif.

[73] Assignee: Taurus Holdings, Inc., Mountain View, Calif.

[21] Appl. No.: 924,374

[22] Filed: Oct. 29, 1986

[51] Int. Cl.[4] ..... B42D 1/00

[52] U.S. Cl. ..... 281/21 R; 402/63; 402/48; 402/62; 402/4; 281/25 R; 411/509

[58] Field of Search ..... 24/67 R, 67 CF, 67 PR, 24/153 R, 153.1; 281/15 R, 21 R, 22, 23, 24, 27, 28, 25 A, 29; 402/48, 50, 51, 52, 53, 61, 62, 63, 64, 68, 80 R, 80 P; 411/509, 510, 908; 412/3, 6, 33, 38, 43

[56] References Cited

U.S. PATENT DOCUMENTS

| | | | |
|---|---|---|---|
| 1,841,989 | 1/1932 | Smith | 281/25 B |
| 3,667,854 | 6/1972 | Jonas | 402/4 X |
| 3,730,560 | 5/1973 | Abildgaard et al. | 281/21 R |
| 3,744,821 | 7/1973 | Abildgaard et al. | 412/6 X |
| 3,833,244 | 9/1974 | Heimann | 281/21 R |
| 3,834,739 | 9/1974 | Abildgaard et al. | 281/21 R |
| 4,072,326 | 2/1978 | Groswith, III et al. | 281/21 R X |
| 4,075 924 | 2/1978 | McSherry et al. | 411/510 X |
| 4,139,216 | 2/1979 | Saint Clair | 281/25 A X |
| 4,175,880 | 11/1979 | Müller | 402/48 |
| 4,606,666 | 8/1986 | Patton | 402/62 |

FOREIGN PATENT DOCUMENTS

| | | | |
|---|---|---|---|
| 3204087 | 8/1983 | Fed. Rep. of Germany | 402/63 |
| 1015952 | 10/1952 | France | 281/21 R |
| 950768 | 2/1964 | United Kingdom | 281/21 R |
| 2065555 | 7/1981 | United Kingdom | 402/63 |

*Primary Examiner*—Paul A. Bell

*Attorney, Agent, or Firm*—Thomas S. MacDonald; Alan H. MacPherson; Paul J. Winters

[57] ABSTRACT

A binder for a stack of punched hole paper sheets utilizes various headed fastener members with a post insertable in the punched holes from one side of the stack. A post connector is utilized on the other side of the stack. The headed fastener members, normally two or three in number corresponding to the number of punched holes in the paper sheets, are captured in recesses and post apertures, punched in a multi-fold carrier made by scoring and folding a thin flexible binder material which serves to encapsulate, capture, space and hold the series of headed fasteners. The fastener posts extend perpendicular to a resultant appreciably stiffened elongated multilayer carrier forming a unitary assembly. In a preferred embodiment, a post connector is also captured and held in a recess within an elongated multi-fold, multilayer carrier forming a second unitary assembly. The multilayer carriers in a preferred embodiment include integral front and rear covers. An integral spine flap also extends from a multi-fold carrier and functions to cover the post and post connector connection at one side edge of the paper stack after the two unitary assemblies have been mounted on the paper stack with the posts of the first assembly extending through the multiple punched holes of the paper stack.

25 Claims, 4 Drawing Sheets

MULTI-FOLD ADJUSTABLE BINDER, BOOK, AND METHOD

RELATED APPLICATION

This application is related to U.S. application Ser. No. 06/840,124 filed 3/14/86, entitled BOOK BINDING METHOD, PAPER SHEETS BINDER AND ADJUSTABLE SPINE, assigned to the same assignee as this application, the disclosure of which is herein incorporated by reference.

FIELD OF THE INVENTION

The present invention relates to encapsulated fasteners for punched-hole paper books, booklets, or reports, and more particularly to back and front covers which encapsulate, hold and conceal post or stud-like and post connection sheet binding members and a method of manufacture of the various parts of the assembly.

BACKGROUND

Loose-leaf paper binders and covers utilizing binder posts inserted into prepunched paper sheets have been employed for many years. For example, U.S. Pat. Nos. 243,730,560, 3,834,739 and 4,072,326 show plastic strip retainers placed at paper stack edges and integral studs in one retainer strip passed through the punched paper holes. An apparatus is provided to shear and upset the stud heads in a recess of the other retainer strip to hold the stack of punched paper sheets together. Provision is also made to fold a cover around the front and back of the book or report, including a spine portion. U.S. Pat. No. 1,841,989 shows strips of sheet metal which press against a fastener head and surround a ratchet post and wherein collars and wedges are hammered on the posts to compress the sheet metal strips and bind sheets of paper and a cover. Covers which are clamped by a series of fasteners are seen in U.S. Pat. No. 3,667,854. Self adhesive layers with removal strips to expose the adhesive have been utilized in the cover art as shown in U.S. Pat. No. 3,833,244. Wraparound covers in which one edge of the cover overlaps a fastener strip is disclosed in U.S. Pat. No. 4,139,216.

SUMMARY

By this invention, a permanent, tamperproof book, booklet, report or the like can be produced using a wide variety of fasteners and binding means, yet without the use of skilled labor or any machine, tool, device, except a hole punch for punching the pages of the book or document. Even the punch can be eliminated with the use of commonly available prepunched paper such as two-hole or three-hole paper.

Rather than placing male and female fasteners individually into the multiple punched holes and somehow incorporating a single folded paper cover thereover or separate front and rear covers with or without a stack spine covering, the present invention utilizes thin flexible binder material which is multi-folded and wrapped to encapsulate, stiffen, and hold as a first unitary assembly a series of fastener male members (and an integral cover, if desired) and a second unitary assembly holding, stiffening, and capturing the fastener female members (also with an integral cover, if desired). The unitary assemblies are placed on the front and rear of a paper sheets stack of a very wide range of thicknesses and when pressed together interconnect the series of captured fastener members together, thus holding the paper sheets stack or book in assembled position.

The binder material acts as a carrier and holder of multiple through-hole fasteners as well as serving as an integral binder cover in the preferred embodiment. Various fasteners and binding means with different features and capabilities may be captured and carried by this uniquely folded cover material while maintaining uniform feel and appearance.

The number of folds depends upon the thickness of the cover material and its adhesive, as well as the thickness of the captured head of the desired fastener, and the desired thickness of the spine material. The resulting binder has thickness, strength and rigidity where desired, yet also thinness and flexibility where desired (such as in the hinge and wrap-around spine areas), all with the use of a single inexpensive yet aesthetically pleasing and continuous binder (seamless) material.

The folded carrier holds multiple fasteners or binding elements, allowing the user to handle one item rather than many; keeps the multiple fasteners properly lined up; keeps them properly spaced; keeps them perpendicular to the plane of the pages for ease of assembly; compensates for the thickness of the heads of the fasteners, bridging the space between heads; and at the same time provides thin, flat aesthetically pleasing surfaces of various colors and textures for cover exteriors, hinges and readily foldable spines that are continuous surfaces without joints, except where the spine flap terminates on the outside back cover.

A variety of configurations is possible by varying the folds and different inserted panels and fastening/binding means. For example, the multi-fold thickness of the material are punched to form recesses for fastener post heads and recesses for fastener connector parts. Posts and buttons as disclosed in the related application have particular utility in the present invention although separate headed pins or studs or screw-type fasteners may be captured by the multi-fold flexible material to form stiffened unitary assemblies of fastener parts.

DETAILED DESCRIPTION OF THE DRAWINGS

Figure 1:
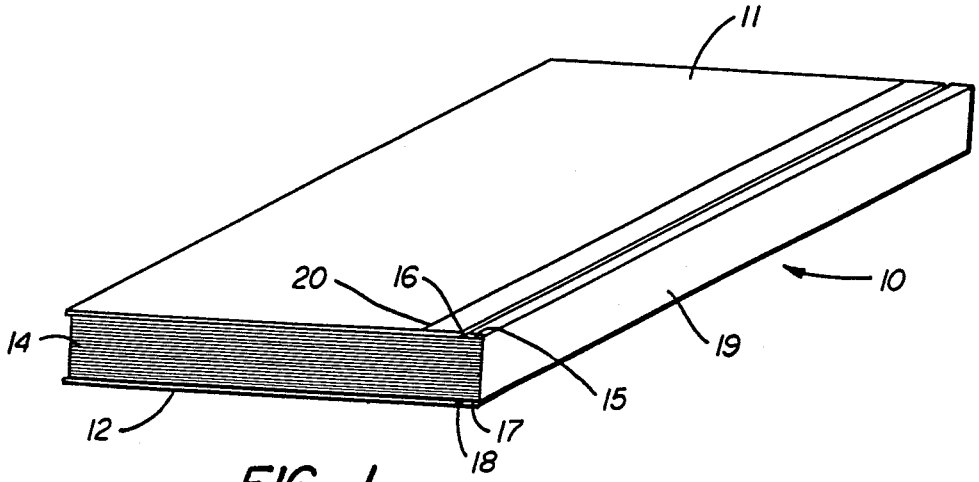
FIG. 1 is a perspective view of an assembled bound book.
Figure 2:
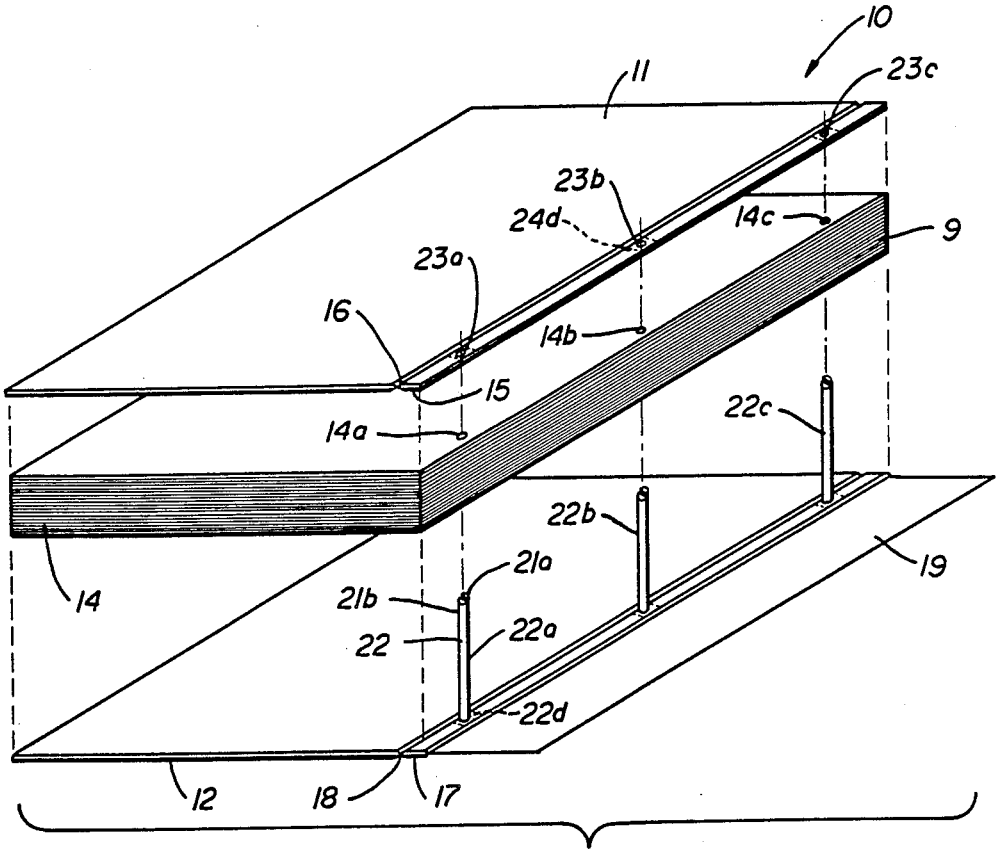
FIG. 2 is an exploded perspective view of the book and its components of FIG. 1 using the adjustable binding elements of the related application.

The complete invention is shown in FIG. 1 as a book 10 with two multi-fold covers 11 and 12. Cover 12 is denoted as the front cover and cover 11 is denoted as the rear cover. The multi-fold covers 11 and 12 contain multifold edge portions or elongated carriers 15 and 17, respectively which as seen in FIG. 2 capture, hold and stiffen and assemble a series of spaced fasteners. Elongated carriers 15 and 17 are denoted as "carriers" since they carry the fastener posts and in the preferred embodiment, carry the post connector. Spine flap 19 extends from multi-fold edge 17 around the spine 9 of a stack of paper sheets 14 and then is folded over the top of multilayer edge carrier 15 to an edge 20 on the rear cover, the ending position being dependent upon the thickness of the stack of sheets 14. Thus, in a thick stack of sheets, edge 20 terminates near the multi-fold portion 15 while in a thin stack of sheets 14, the edge 20 extends to a considerable distance from the multi-fold portion 15. Due to the relative thickness of multi-fold sections 15 and 17, longitudinal hinges 16 and 18 are formed along the height of the cover parallel to carriers 15 and 17, respectively. The front cover of book 10 is thus free of any joints other than the integral hinge while the rear cover 11 contains only the joint formed by the edge 20 of the spine flap 19.

FIG. 2 shows fasteners which are captured by the multi-fold portions of carriers 15 and 17 in a preferred embodiment. A series of post fastener parts 22 denoted individually as post fastener parts 22*a*, 22*b* and 22*c* and a series of fastener connectors 23 together form two-part male and female fasteners. Each of the post fastener parts have a head 22*d*. Each of fastener parts are captured by the multi-folds of carriers 15 and 17 forming two unitary assemblies. The assemblies are positioned at a vertical edge of the paper stack traversing the length of the line between and extending from a series of punched holes 14*a*, 14*b* and 14*c* in the paper stack 14. Post heads 22*d* are recessed within the multi-folds of strip 17 in the front cover, while connector buttons 23*a*, 23*b* and 23*c* are captured within recesses of the multi-fold edge carrier 15 in the rear cover. Posts 22 in the preferred embodiment are bifurcated posts having a first leg 21*a* and second leg 21*b* as more fully disclosed in the related application. A spine flap 19 extends from the multi-fold portion 17.

The user or assembler of the covers and/or fastener carriers 15 and 17 inserts the stiffened carrier 17, more particularly posts 22*a*, 22*b* and 22*c*, through punched holes 14*a*, 14*b* and 14*c*, respectively. The ends of the post legs 21*a* and 21*b* extend through apertures in the various layers of multilayer portion 15 so that the ends of the post legs extend above the planar surface of rear cover 11. As described in FIGS. 4 and 3, the post legs are serrated on their inner surfaces and interact with hinged pawls of connector buttons 23*a*, 23*b* and 23*c*. The circular cross-section of the D-shaped legs 21*a* and 21*b* pass by the hinged pawls until the covers 11 and 12 firmly press the stack 14. Since the ratchet action of the serrations on the post inner surfaces and the pawls act in a one-way direction, the covers 11 and 12 cannot normally be pulled off the stack of papers without damage to the carriers and fasteners. Excess lengths of posts 22 extend above the planar surface 11 of the rear cover and such excess lengths are broken off at the weakened scored minimum cross-section areas between serrations and at a level directly above the pawls in the buttons 23*a*, 23*b* and 23*c*. The ends of the bifurcated post legs are broken off quite smoothly approximately in the same plane as the outer surface of the outer layer of the multifold carriers. Since the broken-off ends of the posts and the pawl construction may be aesthetically unpleasing, it is normally desired that a paper, leatherette or other binding material cover these connections. Thus, a spine flap 19 integral with carrier 17 is wrapped around the spine 9 of the stack of sheets 14 and over the exposed edges of the connection between the bifurcated legs 21*a* and 21*b* and the opposing pawls of button 23. Flap 19 covers these broken ends and extends out to a line 20 at the free edge of the flap 19, providing a more aesthetically pleasing appearance as well as tamper-resistant security.

Figure 3:
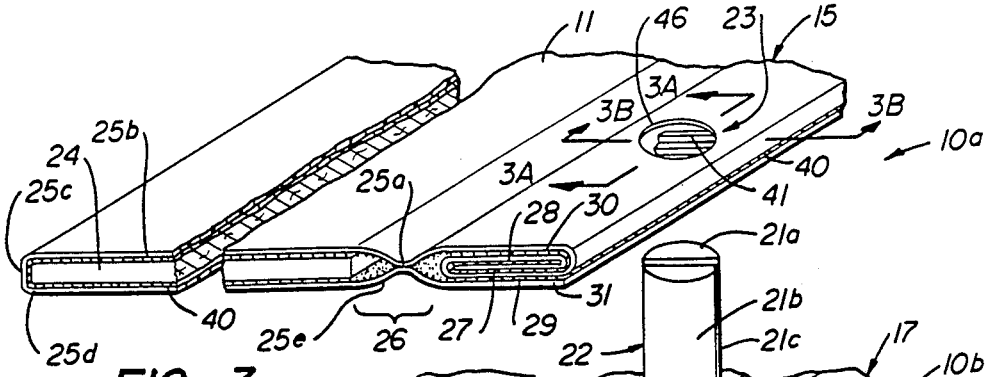
FIG. 3 is a cross-sectional perspective view of a portion of the edge of a back cover carrying the button connector of the related application.

FIG. 3 shows in more detail the multilayered construction of the multilayer elongated carrier 15. Folding formation of a unitary cover or unitary carrier 10*a*, which captures the fastener connector part (button 23), commences with a free end margin 27 of a thin flexible sheet of paper, leatherette or other binder material such as 10-point (0.01 inches thick), i.e. 10 mils, PAJCO material manufactured by Boise Cascade, Lowville, N.Y. The layers which are placed in abutting relationship with a succeeding layer are covered on at least one surface with a conventional bookbinding adhesive. In a five-layer carrier, the locking button 23 is captured between the two outermost layers 30 and 31. The three inner layers 27, 28 and 29 are punched to form a recess having a height approximately of the thickness of the head of the button. For example, button 23 may have a thickness of 30 mils and a recess, formed in three 10 mil layers with thin layers of adhesive, of approximately 30 mils. It is understood that in the case of use with 3-hole punched paper there will be three recesses within the length of the multi-fold carrier 15 spaced apart the same distance as the punched holes in the stack of paper. As shown, continuous layer 28 is folded upon layer 27 and continuous layer 29 folded back on the opposite side of layer 27 to form a three layer configuration within integral outer layers 30 and 31 of the flexible material. After layer 30 has been folded on layer 28, layer 30 extends, outwardly at its free end to form, if desired, a first cover, for the paper sheets 14.

Figure 4:
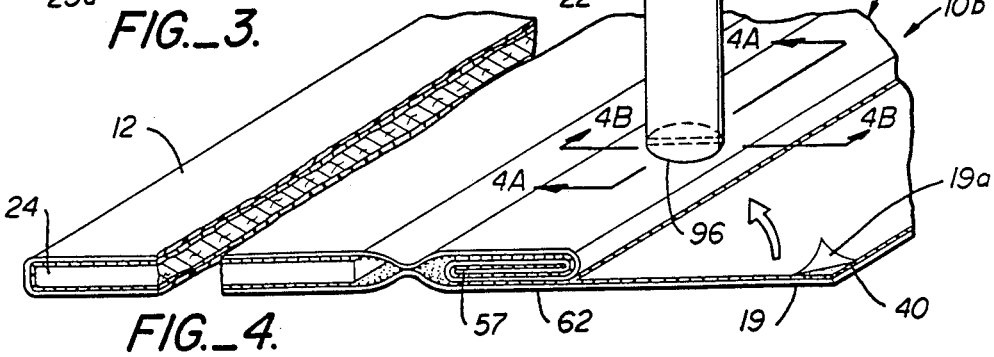
FIG. 4 is a cross-sectional perspective view of a portion of the edge of a front cover carrying the adjustable post of the related application.

As shown, the free end has a short expanse 25*a* which forms the outer portion of a hinge for the cover and a prolongated portion 25*b* which covers a distance slightly in excess of the width of the paper in the stack. The free end of portion 25*b* is then folded upon itself at cover end 25*c* to form a return prolongated portion 25*d* extending to hinge portion 25*e* which, with expanse 25*a*, bridges a gap 26 between multi-fold carrier 15 and the main part of the cover 11. If a stiffened cover is desired, a paperboard or cardboard rigid panel or insert 24 may be encompassed by surfaces 25*b*, 25*c* and 25*d* and extends to the hinge gap 26. Prior to making the third fold, i.e. surface 30, the layers 27, 28 and 29 are apertured by punching out a series of apertures 45 (FIG. 3A) through those layers for capturing the button or other connector part. The peripheral shape of the recess will correspond to the peripheral shape of the connector part being captured. Apertures 45 are three in number and are spaced along multi-fold carrier 15 corresponding to the spacing of posts 22 captured by cover 12 (FIG. 4). Layer 30 is punched to form three circular apertures 46 for passage of post legs 21*a* and 21*b*. The resultant structure of multi-fold carrier 15 has a relatively high stiffness as compared to the thin flexible material being employed in each individual layer of the continuous web of material.

After the free end of the material has been wrapped upon itself to form cover 11, the then free end 31 is likewise apertured with circular apertures 47 to form an access for insertion of the bifurcated legs 21*a* and 21*b* of post fastener 22. Adhesive such as conventional bookbinders glue is also provided on the inner surface of layer 31 so that it adheres to the inner layer 29. Folding the large sheet of flexible cover material is aided by first scoring the material at the desired location of the various folds using conventional scoring machinery. Adhesive may be applied to the inside of the entire sheet of cover material, and the material may then be folded and punched by conventional punching, scoring and folding machinery, and the rigid panel inserted if desired, and the final folding completed by conventional equipment. The connector part may be inserted into the recess and aperture prior to folding and sealing flap 31. The above construction thus forms a unitary assembly of an elongated carrier and three captured buttons for a three-hole punch paper stack with a cover 11 integral with the overall assembly.

Figure 4A:
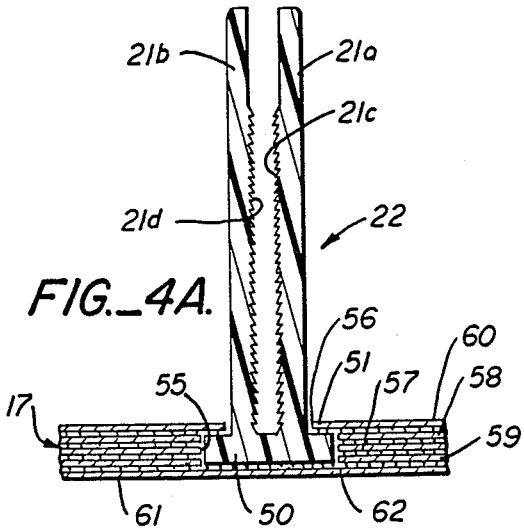
FIG. 4A is a sectional view of FIG. 4 along line 4A—4A.
Figure 4B:
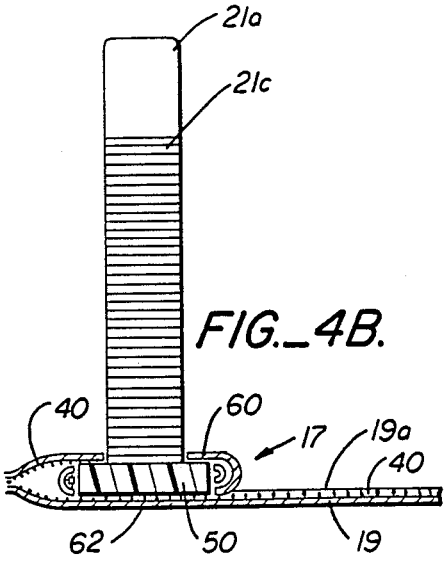
FIG. 4B is a sectional view of FIG. 4 along line 4B—4B.

FIG. 4 shows a complementary unitary assembly 10*b* which employs a multi-fold edge portion or carrier 17 folded in much the same matter as the five-layer fold of FIG. 3 to encapsulate the post fastener parts. In this case, a free end 57 is folded upon itself three times to form internal layers which are punched to form recesses 55 to accept the head 50 of a post (FIGS. 4A and 4B). The inner layer of the flexible material is apertured at 56 to accept post legs 21*a* and 21*b* as in FIG. 4. The flexible material free end continues from the inner surface of the multilayer portion 17 outwardly to form integral cover 12 and includes a reverse bend corresponding to bend 25*c* in FIG. 3 to form a cover of at least two thicknesses of binder material. As in FIG. 3, the two thicknesses of cover material may encompass a filler sheet 24 to give increased stiffness to the cover. Lastly, an imperforate portion 62 of the flexible material is positioned as a fifth layer to support and encompass the top outer surface of head 50 of the headed post 22. Extending from the outer layer 62 is an integral spine flap 19 which is covered with a pressure-sensitive adhesive 40 and a release paper, protecting the pressure-sensitive adhesive, which is removed when the user is ready to wrap and press the spine flap around the bound document.

Figure 3A:
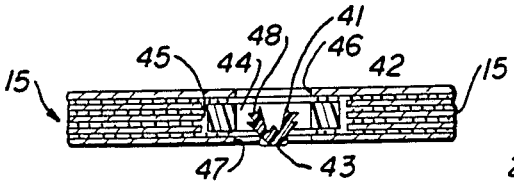
FIG. 3A is a sectional view of FIG. 3 along line 3A—3A.
Figure 3B:
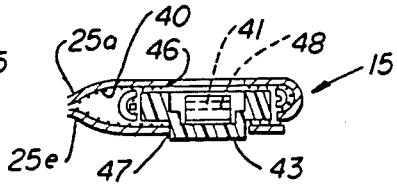
FIG. 3B is a sectional view of FIG. 3 along line 3B—3B.

FIG. 3A is a cross-sectional view of the multilayered structure of the multi-fold carrier 15 showing a square button 23 captured in square recess 45 within the three internal layers of the multi-fold carrier 15. Apertures 46 and 47 on the outer and inner surfaces of the five layer stack of flexible material allow for passage of the serrated bifurcated legs of the post so that the serrations pass by the pawls 41 more particularly locking teeth 48 which lock in one directions with internal serrations 21*c* and 21*d* of the posts. Pawls 41 are connected to a post 43 extending across button collar 42 and being integral therewith. Details of the button are shown in the related application.

As shown in FIG. 4A the headed post fastener part is captured within a recess 55 formed in the three internal layers 57, 58 and 59 of the multi-fold elongated carrier portion 17. The inner layer 60 is apertured at 56 in a circular configuration to pass the diameter of the bifurcated post therethrough. The overlapping edge 51 of the inner layer 60 abuts against the underside of head 50 and captures the headed post within the five layers of flexible material. The outer layer 61 of material which extends from the outer surface of cover 12 remains imperforate in the expanse 62 along the top of the post head 50. The flap 19 with pressure-sensitive adhesive 40 and release paper 19*a* (FIG. 4) completes the construction of the second unitary assembly 10*b*.

Figure 5:
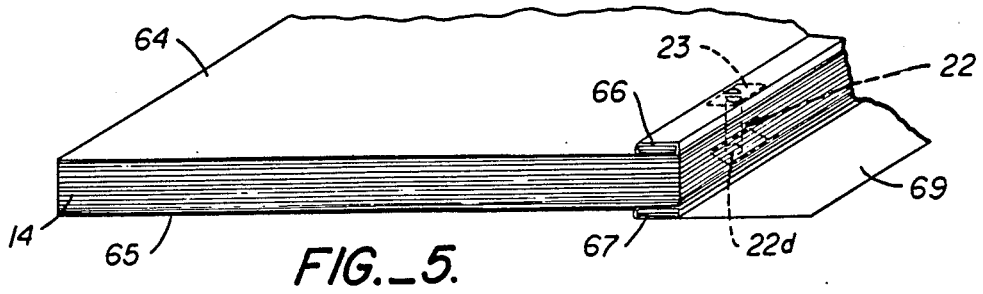
FIG. 5 is a partial perspective view of an assembled document with two separate sheeted cover stocks prior to the spine flap being wrapped around and sealed.

A further embodiment of the invention is seen in FIG. 5 where the multi-fold elongated carriers 66 and 67 capture, hold and stiffen a series of fastener posts 22 and fastener connectors such as button 23 along spaced positions of the multi-fold carrier. Separate nonintegral flexible covers 64, 65 may be provided under the multi-fold carriers 66 and 67 and are apertured at positions corresponding to the spacing of the posts and buttons to allow passage of the posts through the covers and the stack of paper sheets 14. Multi-fold portion 67 may contain a spine flap 69 which is foldable across the spine of sheets 14 and across the connection of the serrations on the bifurcated legs and the buttons after any excess post length is broken off relatively flush with the top surface of multi-fold carrier 66.

Figure 6:
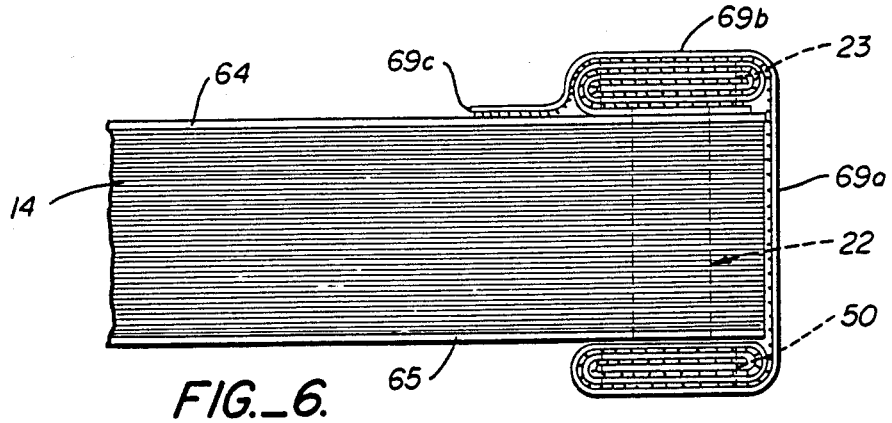
FIG. 6 is an enlarged end view of a portion of FIG. 5 showing the final position of the spine flap for a thick document.

FIG. 6 illustrates a completed binding where the spine flap is shown with a spine portion 69*a*, a portion 69*b* covering the entire length of the multi-fold carrier 66 including covering the connections of posts 22 and buttons with the spine flap terminating at an end 69*c* adhered to cover 64.

Figure 7:
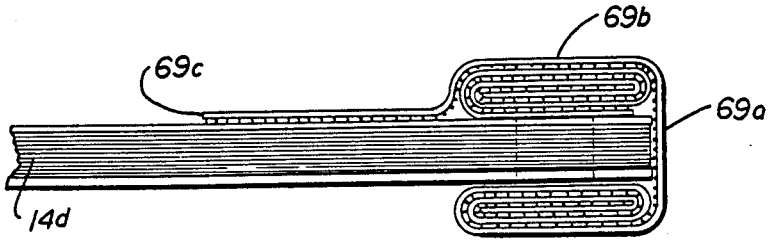
FIG. 7 is an enlarge end view similar to FIG. 6 but for a thinner document, showing the further overlap of the spine flap.

FIG. 7 illustrates a similar construction to FIG. 6 where a thinner stack 14*d* of paper sheets are being bound. In such event, the flap portion 69*a* extending across the spine is shorter in distance and thus the end 69*c* extends a greater distance towards the outer edge of cover 64. It is also contemplated that edge 69*c* may be trimmed so that the end is closer to or adjacent the multi-fold carrier 66.

Figure 8:
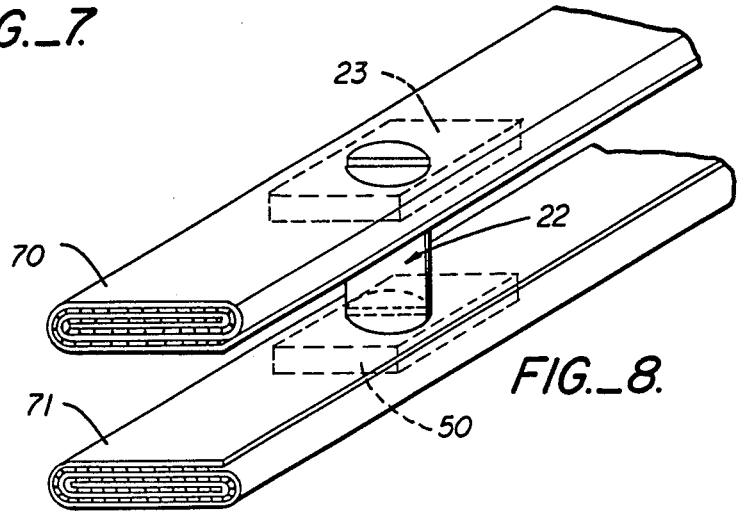
FIG. 8 shows a portion of assembled front and back folded carriers (without a spine) encapsulating the heads of buttons and posts of the related application.

FIG. 8 shows assembled front and back unitary carriers, without a spine and without a cover, the carriers encapsulating or capturing the rectangular heads of buttons and posts of the type shown in the related application. The button 23 is captured by multi-fold carrier 70 and the head(s) 50 of post(s) 22 are captured by the inner recessed layers and inner layer of multi-fold carrier 71.

Figure 9:
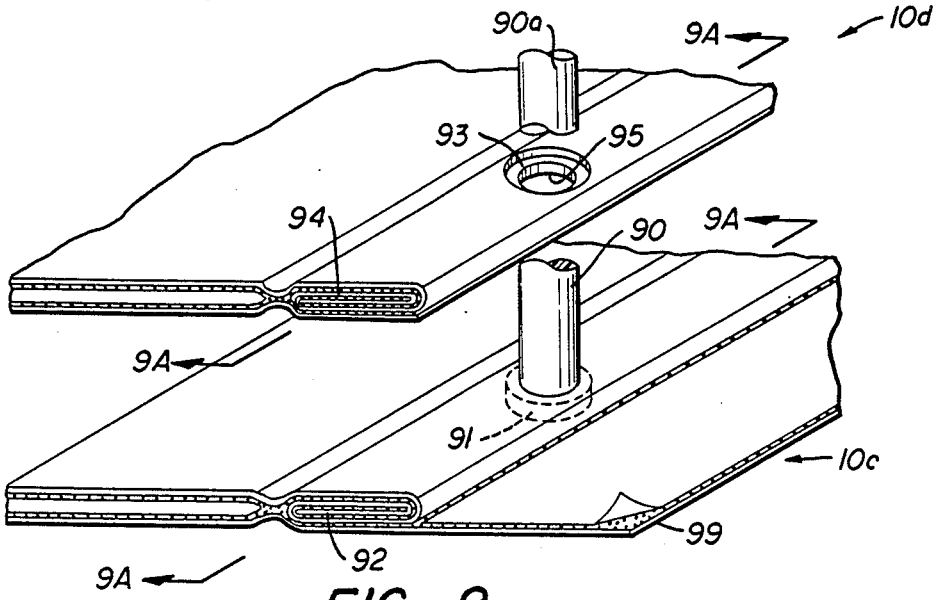
FIG. 9 is a cross-sectional perspective view of a further embodiment.
Figure 9A:
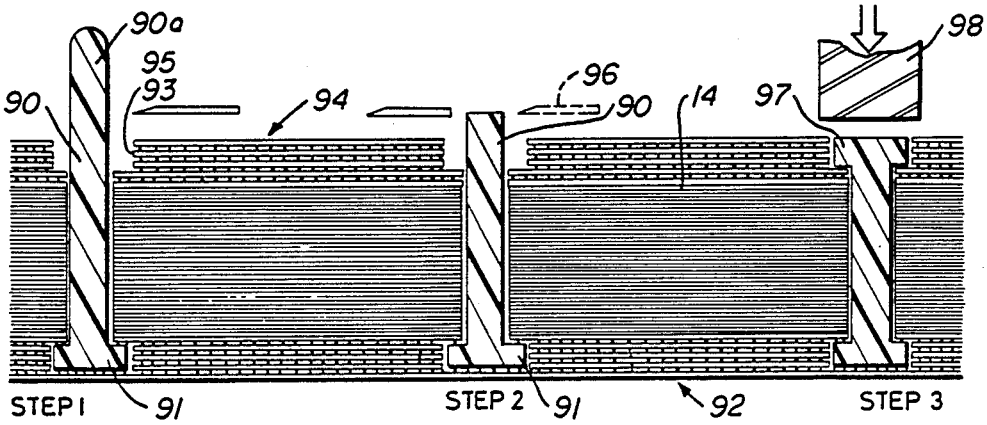
FIG. 9A is a cross-sectional view taken on the lines along 9A—9A of FIG. 9 showing the three steps of assembly, cutting and heading.

FIG. 9 represents a further embodiment of the invention where a headed stud having a post 90 of constant cross section has its head 91 captured by three inner layers 92 of a five-layered structure as in FIG. 4. The stud 90 extends upwardly and passes through an aperture 95 in preferrably two inner layers of multilayer carrier 94 and through a counterbore 93 in the three outer layers of the five-layered carrier 94. Stud 90 is inserted through aperture 95 and extends outwardly from counterbore 93. As shown in FIG. 9A, the post 90 has an extension 90*a* extending above the multilayer carrier 94. After the multilayer carriers 92 and 94 have been firmly pressed together by pressure of a platen (not shown) or other means, a heated knife 96 or other severing device is utilized to cut off the protruding end 90*a* of stud 90, as shown in step 2, and the flat surface of this knife or other upset means 98 heats, deforms and depresses an end of stud 90 remaining above carrier 94 into the counterbore 93 forming a rivet-like head 97 or upset end which holds the stack of paper sheets firmly together. In the FIG. 9 configuration no fastening device or connector part is initially carried in the unitary section 10*d* back cover. This embodiment, however, may necessitate use of a binding machine. The carrier 94 does include apertures of different diameters to receive the stud and the formed rivet head after the tack or stud is severed and upset. The front cover captures and carries multiple tacks or studs corresponding to the number of apertured holes in the stack of papers. A spine 99 may then be wrapped around the spine of the stack of paper sheets to cover the formed head 97 to complete the overall unitary binding section 10*c*.

Figure 10:
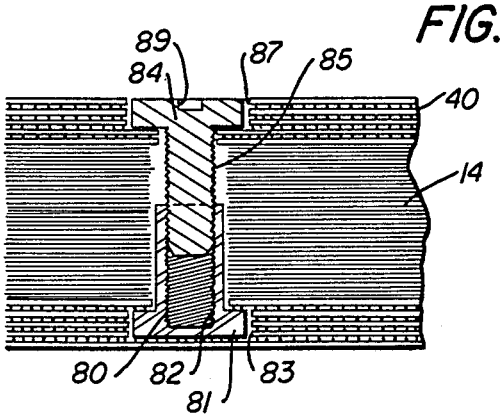
FIG. 10 is a cross-sectional view of an additional embodiment employing screw posts fasteners.

FIG. 10 shows an additional embodiment employing so-called Chicago Screw Posts which are position spaced along an elongated multi-fold carrier such as described above. A female screw member 80 includes a head 81 captured within an internal recess 83 of three internal binder material layers and the screw post passes through a smaller diameter aperture in the inner layer. In the rear carrier (upper one in FIG. 10), a recess 87 is formed in the upper three binder material layers to receive a headed screw post 84 which may be tightened by screw threads 85 into screw threads 82 of post member 80. A slot 89 is provided to tighten the screw member 84 into the post member 80. A wraparound spine flap may also be employed which, after tightening of the screw post 80 and screw member 84 together, would keep the screw member 84 from becoming loose and make such a binding tamper resistant.

The above description of embodiments of this invention is intended to be illustrative and not limiting. Other embodiments of this invention will be obvious to those skilled in the art in view of the above disclosure.

I claim:

1. In combination, a series of two-part fasteners, one part having an elongated post and a headed first end and a second connector part;

a first folded fastener carrier;

said first carrier comprising a thin flexible sheet material having a first edge multi-folded upon itself to form a multiplayer edge, facing surfaces of said multilayer edge being in abutment, said multilayer edge including apertured internal layers forming first internal recesses for receiving and capturing said fastener headed first ends, an inner layer of said multilayer edge facing said elongated posts being apertured to capture an underside of said headed first end, and an imperforate outer layer overlapping said headed first end; and a second folded fastener carrier comprising a thin flexible sheet material having a multilayer portion including second internal recesses extending through multiple layers of said multilayer portion for receiving and capturing a second connector part of each of said fasteners, said second connector part being connectible to said elongated post of such fasteners, such that said series of fasteners holds said first and second carriers together in fixed relation.

2. The combination of claim 1 further including a stack of hole punched paper sheets, said elongated post of each of said series of fasteners extending through said punched holes and said carriers extending over a punch hole margin of said paper sheets stack on opposite sides of said stack.

3. The combination of claim 1 further including a series of fasteners spaced along said first edge, each fastener being captured and retained by said first and second carriers.

4. The combination of claim 1 in which said internal layers collectively of said first carrier and said first internal recesses have a height approximate a thickness dimension of said fastener headed first end.

5. The combination of claim 1 further comprising an integral spine portion extending from one of said carriers.

6. The combination of claim 1 further comprising a cover connected to and extending from each of said first and second carriers.

7. The combination of claim 6 in which one of said first and second carriers includes an integral spine flap extending from one of said multilayer edges, said spine flap being foldable around a spine of a stack of sheets between said carriers and extending to the other of said carriers over said fasteners and being affixed to one of said covers.

8. The combination of claim 6 in which each of said covers and an adjacent one of said carriers are each made from a continuous length of flexible material.

9. The combination of claim 8 further including a stiffening insert within said covers, said stiffening insert being spaced from said carriers such that a double thickness of said continuous length of material bridging said spaced carrier and insert forms an integral cover hinge therebetween.

10. The combination of claim 6 in which said covers are essentially coplanar with an outer surface of said first and second carriers.

11. The combination of claim 6 in which said covers include a front cover and back cover, and further including a spine flap integrally extending from one of said carriers abutting said front cover around a spine of a stack of sheets being clamped by said carriers and said series of fasteners to, over and past the other of said carriers to affixation on said back cover.

12. The combination of claim 1 in which said elongated posts are serrated and said connector second part includes a locking button having a hinged pawl, said buttons being captured in said second internal recesses.

13. The combination of claim 1 in which said elongated post is a stud of constant cross-section and said second connector part includes upset post ends within said second internal recesses.

14. The combination of claim 1 in which a series of spaced studs are captured in said first carrier.

15. The combination of claim 1 in which said elongated post is a threaded post and said connector second parts are headed screws, the heads of such screws being recessed within said second internal recesses.

16. A book comprising a plurality of hole punched sheets; a series of fasteners each having an elongated post, a first headed end on said post and a second connector part; and a pair of carriers of flexible material, one of said carriers having a first multi-folded, multilayered, peripheral edge including a series of first internal, recesses receiving and capturing said fastener posts headed ends, the other of said carriers having a second multi-folded, multilayered, peripheral edge portion including a series of second internal recesses extending through at least one of said multiple layers of said other carrier for receiving and capturing said fastener second connector parts.

17. The book of claim 16 further including a stack of hole punched paper sheets, said elongated posts extending through said punched holes and said carriers extending over a punch hole margin of said paper sheet stack on opposite sides of said stack.

18. The book of claim 16 further comprising an integral spine portion extending from one of said carriers.

19. The book of claim 16 further comprising a pair of covers connected to and extending from said first and second carriers.

20. The book of claim 16 in which said elongated posts are serrated and said connector parts includes a locking button having a hinged pawl, said buttons being captured in said second internal recesses.

21. The book of claim 16 in which said elongated posts are studs of constant cross-section and said connector parts includes upset post ends within said second internal recesses.

22. The book of claim 16 in which a series of spaced studs are captured in said first carrier.

23. The book of claim 16 in which said elongated posts are threaded posts and said connector parts are headed screws, the head of each screw being recessed within said second internal recesses.

24. A binder strip for use in binding a stack of perforated paper sheets comprising:

a length of thin flexible binder material;

said binder material having an end folded upon itself to form an elongated strip of abutting multiple layers of binder material, said abutting multiple layers forming a stiffened strip assembly;

means in said multiple layers for forming a series of recesses to receive and capture a series of binder connector parts; and menas in an outer layer of said multiple layers for forming apertures of a smaller width than a width of said series of recesses to prevent movement in an axial direction of binder connector parts in said strip.

25. The binder strip of claim 24 wherein said length of flexible binder material includes a free end integrally extending from said strip for a distance sufficient to form a paper sheets cover.

* * * * *

UNITED STATES PATENT AND TRADEMARK OFFICE

CERTIFICATE OF CORRECTION

PATENT NO. : 4,743,048

DATED : May 10, 1988

INVENTOR(S) : Charles T. Groswith, III

It is certified that error appears in the above-identified patent and that said Letters Patent is hereby corrected as shown below:

In the drawings, Sheet 1, Fig. 2, delete "24d".

In the drawings, Sheet 2, Fig. 4, the reference numeral "96" should be changed to --56--.

In the drawings, Sheet 2, Fig. 3A, a lead line should be added extending from reference numeral 42 to the cross-hatched collar surrounding pawls 41.

In the drawings, Sheet 4, Fig. 9A, a lead line should be added extending from reference numeral 95 to the aperture directly below counterbore 93 and through which the stud 90 passes as shown also in Fig. 9.

Col. 7, line 50, "multiplayer" should read --multilayer--.

Col. 10, line 17, "menas" should read --means--.

Signed and Sealed this

Twentieth Day of December, 1988

*Attest:*

DONALD J. QUIGG

*Attesting Officer*

*Commissioner of Patents and Trademarks*